United States Patent [19]

Ortheil, deceased

[11] 3,971,625

[45] July 27, 1976

[54] BASIC DYEING

[75] Inventor: Hans Ortheil, deceased, late of Spartanburg, S.C., by Hildegard M. Ortheil, administratrix

[73] Assignee: Kane and Company, Gastonia, N.C.

[22] Filed: Mar. 16, 1973

[21] Appl. No.: 342,183

[52] U.S. Cl. ..... 8/82; 8/173; 8/85 B; 8/172 A

[51] Int. Cl.[2] ..... D06P 1/68

[58] Field of Search ..... 8/82, 4, 85, 172, 173

[56] References Cited

UNITED STATES PATENTS 3,666,398 5/1972 Tratynek ..... 8/4

3,802,835 4/1974 Prieto ..... 8/1

FOREIGN PATENTS OR APPLICATIONS 628 1854 United Kingdom ..... 8/72

OTHER PUBLICATIONS

Taft, J. Physical Chemistry, 1930, pp. 2792–2800.

*Primary Examiner*—Donald Levy

*Attorney, Agent, or Firm*—Schiller & Pondiscio

[57] ABSTRACT

A dye system in which materials are bathed in a dyebath formed of a basic dye dissolved in a body of liquid ammonia.

8 Claims, No Drawings

BASIC DYEING

This invention relates to systems of dyeing or coloring materials with basic dyes and more particularly to new methods of dyeing materials such as proteinaceous, cellulosic and synthetic fibers and sheets with basic dyes.

Basic dyes are usually applied to fibrous material from aqueous solution, and generally require imbibition periods of many minutes even with heated solutions. Additionally, basic dyes capable of dyeing one type of fiber in aqueous solution are often ineffective for other types of fiber or may require mordanting the fiber prior to dyeing.

Basic dyes are water-soluble dyes that react as bases because of the presence of nitrogen-containing groups. They have a very high tinctorial value and brightness of color. They exhaust from aqueous dyebaths onto lignocellulosic fibers such as jute, coir, raffia and the like, without mordanting. These dyes have also been used for dyeing wool and silk directly, as well as acetate, nylon and polyester fibers, and furs and leather, all from aqueous baths.

The usual dyeing systems and the type of fibers for which a basic dye is particularly useful have heretofore been largely limited to dyeing from aqueous solution. While dyeing from aqueous solution systems may provide reasonably satisfactory dyeings from a standpoint of color tone and dye levelness, such systems have the disadvantage in usually requiring relatively long imbibitions times, e.g., typically from about 30 minutes – 10 hours or more. As a result, the dye vats, etc., must be relatively large thus increasing capital investment. Furthermore, such systems normally require relatively high dyebath temperatures which may often approach the boiling point of water. Such increases utility costs of operating the system. An additional disadvantage of aqueous systems is pollution from disposal of spent dyeing solutions. Also, basic dyes are not normally applied to cotton notwithstanding the desirably high tinctorial value and brightness of color, since basic dyeing from aqueous systems requires first mordanting the cotton, e.g. with tannin or the like, which is often a time consuming procedure.

A method of dyeing with selected dyestuffs from liquid ammonia solution has been disclosed by Tratnyek in U.S. Pat. No. 3,666,398. In this method, direct, disperse, napthol, reactive and sulfur dyes may be dissolved in liquid ammonia and applied to various types of fibers. An advantage of the Tratnyek method is that imbibition time is radically less as compared to dyeing from aqueous systems. Also, in this method dyeing is accomplished at low temperatures, and does not involve the use of costly solvents. On the other hand, when basic dyes are mixed with liquid ammonia, many will not dissolve sufficiently to impart reasonable color to the bath, and in a few instances when dissolved tend to become colorless. Also, fastness of some basic dyes applied from liquid ammonia on some materials such as acrylic and modacrylic fibers tended to be not adequate for commercial purposes in some instances. As a result the Tratnyek method has heretofore been considered as not particularly suitable in the case of many basic dyes.

It is thus a primary object of the present invention to provide a novel dyebath for dyeing substrate materials. A more specific object of the invention is to provide a novel method of dyeing with basic dyes applied from liquid ammonia solution.

To effect the foregoing and other objects, the present invention generally contemplates solubilizing a basic dye in liquid ammonia. In one embodiment of the invention a basic dye is dissolved directly in the liquid ammonia. In a second embodiment of the invention a basic dye is first dissolved in a selected liquid organic solvent therefor. The organic solvent is necessarily miscible with liquid ammonia. The dye-solvent mixture is then mixed with liquid ammonia to form a dyebath.

Other objects of the invention will in part be obvious and will in part appear hereinafter. The invention accordingly comprises the processes involving the several steps and the relation of one or more of such steps with respect to each of the others, and the products possessing the features, properties and relation of elements which are all exemplified in the following detailed disclosure and the scope of the application of which will be indicated in the claims.

In the following detailed description of the present invention, the term "liquid ammonia" refers to ammonia ($NH_3$) in its liquid state, i.e., which boils at about −33.4°C at 760 Hg. pressure, and not to a solution of ammonium hydroxide. However, it will be appreciated that water can be mixed with liquid ammonia in surprisingly large amounts without the water becoming frozen. Even when approximately equal quantities of liquid ammonia and water are mixed, there remains an appreciable quantity of the liquid ammonia in the mixture so long as the mixture is maintained at equilibrium conditions below the boiling point of the liquid ammonia.

As used herein the term "basic dye" refers to water soluble dyes which react as bases due usually to the presence of certain nitrogen-containing groups, e.g. amino groups, all as well known.

The organic solvent is an organic liquid which is capable of dissolving the basic dye and which is also non-reactive with the dye and with liquid ammonia. Organic liquids which are capable of dissolving basic dyestuffs without altering dye characteristics and which are also miscible with liquid ammonia are available commercially among which may be mentioned dimethylsulfoxide $((CH_3)_2SO)$ and dimethylformamide $((CH_3)_2\ NOCH.)$ A particularly preferred solvent is tetramethylene sulfone (tetrahydrothiophene 1-1 dioxide), available from Shell Chemical Company, USA under the trademark "Sulfolane." The latter is believed to have the structural formula

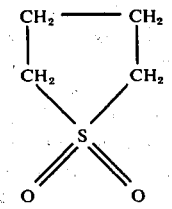

Generally, a basic dyestuff is mixed in a body of liquid ammonia to form the dyebath. In the case where the basic dyestuff is not directly soluble in liquid ammonia a mixture of the basic dyestuff and a solvent therefore is first prepared by mixing the dyestuff and solvent in a weight ratio in the range of about 0.01 to 2 parts by weight dyestuff to solvent, preferably in about 1 to 1 parts by weight of dyestuff to solvent, forming either a thick liquid or a paste (depending on the ratio of dyestuff-to-solvent). Thereafter, the dyestuff-solvent mixture is mixed with the liquid ammonia to form a dyebath. The dyestuff, or dyestuff-solvent mixture is preferably mixed with the liquid ammonia in an amount in the proportion of from about 0.01 to 10 parts by weight dyestuff per 100 parts by weight liquid ammonia to form the dyebath.

The dyebaths of the present invention are effective for dyeing a wide range of materials to which they are applied, for example, cotton, silk, wool, viscose, rayon, acetate, triacetate, acrylic, modacrylic, nylon, polyester, and other natural and synthetic materials. Some basic dyes which tended to become colorless when mixed directly with liquid ammonia, retained their color when they were first mixed with organic solvent as described herein prior to being mixed with the liquid ammonia. In the liquid ammonia dyebath, dyeing is generally completed in about 20 seconds or less, although application of the same dye to the same material with conventional aqueous systems employs much longer imbibition times and much higher dyebath temperatures.

The depth of shade achieved in the present invention as in the use of liquid ammonia dyebaths appears to depend primarily on the concentration of the dyestuff in the liquid ammonia solution, and not on dwell time of the fibers in the dyebath. Imbibition periods greater than about 20 seconds do not normally materially improve coloration.

That mixing the basic dye-liquid ammonia solution as described herein is responsible for the unique consequences achieved is quite clear inasmuch as dyebaths prepared from the same dye dissolved in water, in ammonium hydroxide and in various organic solvents, failed to provide comparable results.

The following examples, illustrative of the principles of the present invention, are based upon application of a bath of a dyestuff dissolved in a body of substantially anhydrous liquid ammonia, to a number of different materials as follows: (1) bleached 80 × 80 cotton print cloth; (2) bleached mercerized 80 × 80 cotton print cloth; (3) spun viscose rayon print cloth (high wet modulus); (4) spun triacetate cloth and (5) a multifiber test fabric consisting of cloth bands of the following sequence of fibers identified generically, and in some instances by trade name; dull acetate; acrylic (Acrilan 1956); triacetate (Arnel dull); raw cotton; acrylic (Creslan 61), polyester (Dacron 54); polyester (Dacron 64); nylon (Nylon 60); acrylic (Orlon 75); silk; modacrylic (Verel A); viscose; and wool.

Generally, in the following examples, the liquid ammonia solution was substantially anhydrous. Dye concentrations in the solutions were as indicated with a total fabric-to-liquid ratio of about 20 to 1 in all cases.

The basic procedure was to submerge all swatches of fabric in the dye solution for twenty seconds. Excess ammonia and solvent was allowed to evaporate from the treated fabrics at room temperature (about 20°C) before drying in an oven at 120°–140°C for about 1 to 2 minutes. The dyed fabrics were then usually rinsed or washed in warm water. Rinsing the fabrics was continued until excess dye was removed from the fabrics or until rinse water showed little or no coloring. The fabrics were dried by ironing.

EXAMPLE I

Dye: Sevron Orange G, C.I. Basic Orange 21, (C.I. No. 48035)

Anhydrous ammonia application — Sevron Orange G does not dissolve directly in anhydrous liquid ammonia. When an effort is made to dissolve the dyestuff (2 gms.) directly in anhydrous liquid ammonia (100ml.) dye particles are observed to remain suspended in the liquid ammonia.

Saturate the fabrics (11.8 gms. total) in the dyebath for 20 seconds. Remove fabrics from dyebath and allow excess ammonia to evaporate at 20°C. Finish drying at 135°C for about 2 minutes. Rinse in warm water and iron dry as above.

Anhydrous ammonia — liquid organic solvent application: Mix 2 gms. of the dyestuff with 2 gms. of tetramethylene sulfone (available from Shell Chemical Company, U.S.A. under the tradename "Sulfolane"). A paste results. Mix the resulting paste with 100 ml. of liquid ammonia. A dyebath is formed which is observed to have a bright orange color. No separation of dye is observed. Saturate the fabrics (11.0 gms. total) in the dyebath for about 20 seconds. Remove fabrics from dyebath and dry the fabrics at 20°C to remove excess ammonia and the sulfone before final drying at 135°C for about two minutes. Rinse in warm water and iron dry.

Application of dyestuff from anhydrous ammonia by itself produces speckled coloration in the fabrics. Application of dyestuff from ammonia and tetramethylene sulfone produces even intense coloration of Arnel and silk. Viscose, cottons, Dacron 64, Acrilan and Orlon 75 are dyed to lighter shades.

EXAMPLE II

Dye: Astraviolet 3R Extra (Verona) C.I. Violet 16, (C.I. No. 48013

Anhydrous ammonia application — Prepare the dyebath by mixing 2 gms. of dyestuff with 100 ml. anhydrous liquid ammonia. The dyestuff will be observed to dissolve in the liquid ammonia forming an emulsion.

Saturate the fabrics (11.4 gms. total) in the dyebath for 20 seconds. Remove fabrics from dyebath and allow excess ammonia to evaporate at 20°C. Finish drying at 135°C for about 2 minutes. Rinse in warm water and iron dry as above.

Anhydrous ammonia-liquid organic solvent application: Mix 2 gms. of the dyestuff with 2 gms. of tetramethylene sulfone. A paste results which is observed to have a deep violet color. Mix the resulting paste with 100 ml. of liquid ammonia. A dyebath is formed which is observed to have a deep violet color. No separation of dye is observed. Saturate the fabrics (11.8 gms. total) in the dyebath for about 20 seconds. Remove fabrics from dyebath and dry the fabrics at 20°C to remove excess ammonia and the sulfone before final drying at 135°C for about 2 minutes. Rinse in warm water and iron dry.

Application of dyestuff from anhydrous ammonia by itself produces medium coloration in the fabrics. After rinsing in warm water some of the coloration is removed. Application of the dyestuff from ammonia and tetramethylene sulfone produces intense coloration of dull acetate, triacetate, viscose, modacrylic and silk. Cottons, Creslan and Dacron 64 are dyed to a medium shade. Acrilan, Dacron 54, Nylon 66 and Orlon 75 are dyed to relatively light shades.

EXAMPLE III 480,55).

The purpose of this example is to see if dyeing coloration varies with the ratio of dyestuff-to-solvent.

Following the procedure described in Example II, mixtures are prepared of the following amounts of dye Astraviolet 3R Extra (Verona), C.I. Basic Violet 16, (CI. No. 48013) and tetramethylene sulfone (all parts by weight).

A. 0.01 parts dyestuff and 1.0 parts tetramethylene sulfone

B. 0.5 parts dyestuff and 1.0 parts tetramethylene sulfone

C. 1.5 parts dyestuff and 1.0 parts tetramethylene sulfone

D. 2.0 parts dyestuff and 1.0 parts tetramethylene sulfone

Prepare dyebaths by mixing mixtures A–D with 100 ml liquid ammonia. In each case a solution results which is observed to have a deep violet color.

Saturate samples of the fabrics in the dyebaths for about 20 seconds. Remove the fabrics from the dyebath and dry the fabrics at 20°C to remove excess ammonia and sulfone before final drying at 135°C for about two minutes. Rinse as before. Iron Dry.

Results — By comparing swatches with those obtained in Example II one sees that increasing the amount of dyestuff does increase the depth of shade.

EXAMPLE IV

The purpose of this example is to see if other liquid organic solvents which are capable of dissolving a basic dye, and are also miscible with liquid ammonia, can be used to effect dyeing with basic dyes from liquid ammonia.

Following the procedure described in Example II, mixtures are prepared with the following amounts of the following selected solvents and basic dye Astraviolet 3R Extra, (Verona) C.I. Basic Violet 16, (C.I. No. 48013) in 200 ml. portions of anyhdrous liquid ammonia.

A. 3.9 gms of dyestuff and 4.1 gms of dimethyl sulfoxide

B. 3.8 gms of dyestuff and 4.0 gms of dimethyl formamide

In such case the resulting solution is observed to have a deep violet color. Apply dye solution to fabrics, dry, rinse and wash as before. Iron dry.

Results — By comparing swatches with those obtained in Example II one sees that the dyeings are substantially comparable in the case of Acrilan, Triacetate, cotton, Creslan, Dacron 54, Dacron 64, Nylon 66, Orlon 75, silk, viscose, modacrylic and wool. Dyeing dull acetate from liquid ammonia and dimethyl sulfoxide produces intense coloration as with dimethylene sulfone, but only medium shade from liquid ammonia and dimethyl formamide. However, color fastness of dyeings obtained in Example II is somewhat superior in some instances.

EXAMPLE V

Dye: Sevron Red GL (DuPont) C.I. Basic Red 18, (C.I. No. 11085).

Mix 3.9 gms of dyestuff with 4.1 gms of tetramethylene sulfone to form a paste. Dissolve the paste in 240 ml. of anhydrous liquid ammonia. The solution is observed to have a deep red color. The fabrics (14.6 gms. total) are saturated in the dyebath for 20 seconds and then drained and air dried at 20°C to remove excess ammonia. Final drying is at 135–140°C for several minutes. Finally, the fabrics are washed and ironed dry as before. Sevron Red GL dyes Arnel and silk in dark shades. Medium shades are obtained for Verel A and viscose. Dacron 64, Creslan 61, acetate, cotton and Acrilan are lightly colored. Dacron 54 and Nylon 66 are stained but not dyed.

EXAMPLE VI

Dye: Sevron Yellow R, C.I. Basic Yellow 11 (C.I. No. 480.55).

Mix separate 4.0 gm. portions of dyestuff with 4.1 gm. portions of tetramethylene sulfone, dimethylsulfoxide and dimethyl-formamides to form pastes. Dissolve the pastes in separate 220 ml. portions of anhydrous liquid ammonia. The solutions are observed to have bright yellow colors.

Saturate fabric samples in the dyebaths, drain, dry, wash and iron dry as before.

Results — Sevron Yellow R dyes Acetate, Arnel, cotton, Creslan, silk and wool in dark shades from all three solutions; and Acrilan in medium shades. Nylon and viscose are also dyed in dark shades from the dimethylsulfoxide and dimethylformamide-containing solutions, and in medium shade from the tetramethylene sulfone-containing solution. Orlon 75 is dyed in dark shade from the tetramethylene sulfone-containing solution and in medium shades from the dimethylsulfoxide and dimethylformamide-containing solutions, and is stained but not dyed by the tetramethylene sulfone-containing solution.

As appears clearly from the foregoing, dyeing with basic dyes can be achieved from liquid ammonia with all the advantages of speed and low temperature achieved by the Tratnyek process by first dissolving the basic dye in a selected solvent therefor, and thereafter dissolving the dye-solvent mixture in liquid ammonia.

Since certain changes may be made in the above systems without departing from the scope of the invention herein involved, it is intended that all matter contained in the above description shall be interpreted in an illustrative and not in a limiting sense.

What is claimed is:

1. A dyebath comprising in combination:

a body of liquid ammonia having a liquid organic solvent selected from the group consisting of tetrahydrothiophene 1—1 dioxide, dimethylsulfoxide and dimethylformamide dissolved therein, and a basic dyestuff compatible with said liquid ammonia, dissolved in said liquid organic solvent.

2. A dyebath as defined in claim 1 wherein said dyestuff is present in the range of from 0.01 to 10.0 parts by weight of dyestuff to 100 parts by weight liquid ammonia.

3. A dyebath as defined in claim 1 wherein said dyestuff and said solvent are present in the range of from 0.01 to 2.0 parts by weight of dyestuff to solvent.

4. A dyebath as defined in claim 1 wherein said solvent comprises tetramethylene sulfone having the formula:

-continued

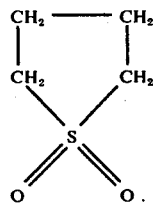

5. A method of forming a dyebath comprising:

mixing a basic dyestuff, compatible with liquid ammonia, with an organic liquid solvent therefor selected from the group consisting of tetrahydrothiophene 1—1 dioxide, dimethylsulfoxide and dimethylformamide; and mixing the solvent-dye mixture resulting with liquid ammonia.

6. A method as defined in claim 5 wherein said solvent comprises tetramethylene sulfone having the formula -continued

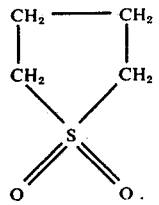

7. In a method of dyeing organic materials by applying to said materials a dyebath comprising a basic dyestuff in solution, the improvement comprising:

mixing a basic dyestuff, compatible with liquid ammonia, with a liquid organic solvent therefor selected from the group consisting of tetrahydrothiophene 1—1 dioxide, dimethylsulfoxide and dimethylformamide, and mixing the dyestuff-solvent mixture resulting with liquid ammonia to form said dyebath.

8. A method of dyeing fabrics with a basic dyestuff comprising saturating the fabrics in a dyebath comprising a body of liquid ammonia having admixed therein a liquid organic solvent for said basic dyestuff selected from the group consisting of tetrahydrothiophene 1—1 dioxide, dimethylsulfoxide and dimethylformamide, and a basic dyestuff compatible with said liquid ammonia.

* * * * *